United States Patent [19]

Tissot et al.

[11] 4,372,225

[45] Feb. 8, 1983

[54] PANEL STRUCTURE FOR PUBLIC ENCLOSURES

[76] Inventors: Alain Tissot, 44 avenue de l'Abbaye, 77500 Chelles; Claude Bourlier, 3, rue J.F. Belbeoch, 94410 St. Maurice, both of France

[21] Appl. No.: 241,239

[22] Filed: Mar. 6, 1981

[51] Int. Cl.[3] ..... E06B 7/32

[52] U.S. Cl. ..... 109/19

[58] Field of Search ..... 109/19, 10, 9; 52/239

[56] References Cited

U.S. PATENT DOCUMENTS

| | | | |
|---|---|---|---|
| 2,105,204 | 1/1938 | Soderholm | 109/19 |
| 2,401,226 | 5/1946 | Calvert | 109/10 |
| 2,648,300 | 8/1953 | Beedle | 109/19 |
| 3,059,840 | 10/1962 | Graber et al. | 232/44 |
| 3,298,329 | 1/1967 | Carstens et al. | 109/10 |
| 3,429,082 | 2/1969 | Stickland et al. | 52/28 |
| 3,702,101 | 11/1972 | Moore | 109/19 |
| 3,759,195 | 9/1973 | Hitrys et al. | 109/9 |
| 4,090,335 | 5/1978 | Curatolo | 52/239 |

FOREIGN PATENT DOCUMENTS

| | | | |
|---|---|---|---|
| 19592 | 11/1980 | European Pat. Off. | 109/19 |
| 1290062 | 3/1965 | Fed. Rep. of Germany | 52/239 |
| 425788 | 4/1911 | France | 109/19 |

*Primary Examiner*—Gene Mancene
*Assistant Examiner*—Wenceslao J. Contreras
*Attorney, Agent, or Firm*—Andrus, Sceales, Starke & Sawall

[57] ABSTRACT

The constructional element defines between the public and an officer isolated in another premises a transparent partition structure which, however allows oral communication and exchanges of objects or documents between the two sides of the element. This element comprises a counter surmounted by a wall of transparent material which makes with respect to a transverse horizontal plane of the counter an angle which is less than a right angle on the public side of the element. The element comprises two spaced apart lateral posts contained in vertical planes and having elongated upper parts supporting the transparent wall and wider lower parts providing a suitable supporting polygonal structure for the element. The upper part of the counter and the lower wall are maintained between the lower parts of the posts.

11 Claims, 2 Drawing Figures

PANEL STRUCTURE FOR PUBLIC ENCLOSURES

Public premises, whether it concerns banks, tax collecting offices, post offices, stations or other administration offices, usually have a common hall which is reserved for the public and is separated from the private premises reserved for the administrative officers by one or more partitions having windows and counters which permit, in full view the exchange of documents or fiduciary money and perfectly audible oral communications. The major drawback of this type of separating wall resides in the fact that it provides only a relative security for the officers in respect of attack in particular because these walls do not extend up to the ceiling and can be easily climbed over by the criminals.

Consequently, an object of the invention is to overcome these drawbacks and to provide a constructional element which satisfies the conditions of the aforementioned communication and exchanges but is designed to be proof against both the physical passage of the attackers and the passage of bullets, this element being moreover designed to perfectly match aesthetically modern constructional and decorative materials and equipment so as not to impair the overall harmony.

Further, the constructional element may be combined by a simple juxtaposition with one or more adjacent identical elements so as to form a continuous stable wall of high security.

The invention provides a constructional and decorative element for the equipment of premises used by the public for the purpose of defining between the public and an officer isolated in another premises, a transparent separating structure which nonetheless permits oral communications and exchanges of objects or documents, said element comprising a counter surmounted by a structure of transparent material which makes, with respect to the horizontal plane of the counter, an angle which is less than a right angle when measured on the public side.

According to a feature of the invention, the wall which extends from the counter to the ground also makes an angle, with respect to the transverse horizontal plane of said counter, which is less than a right angle when measured on the public side.

In a preferred embodiment, the element comprises two spaced-apart posts in the form of slideways, and a lower wall and an upper wall of unequal height, each of said walls making an acute angle with respect to an imaginary vertical plane separating the officer from the public, the two walls converging towards each other to a junction point located slightly above the level of the counter.

Figure 1:
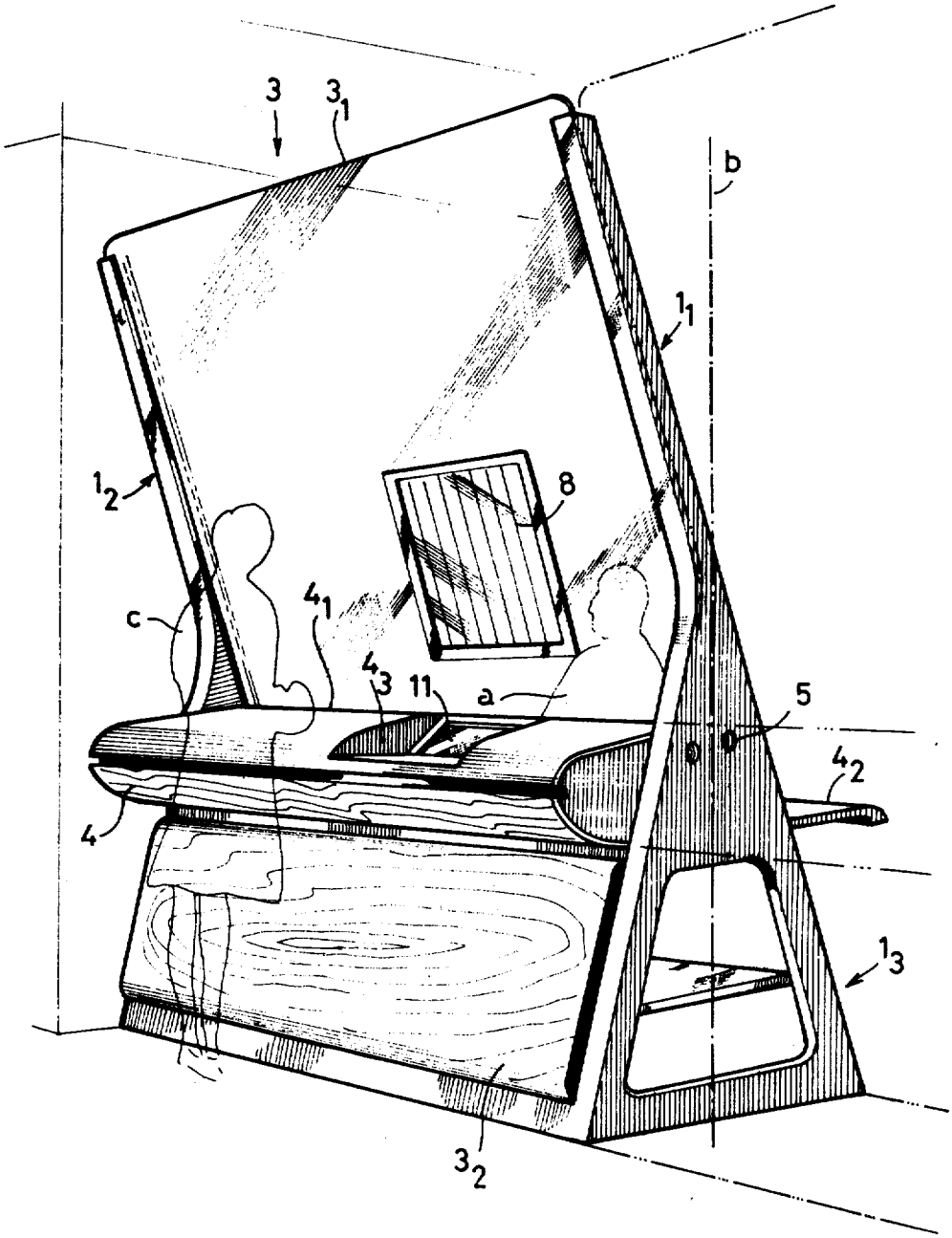
Figure 2:
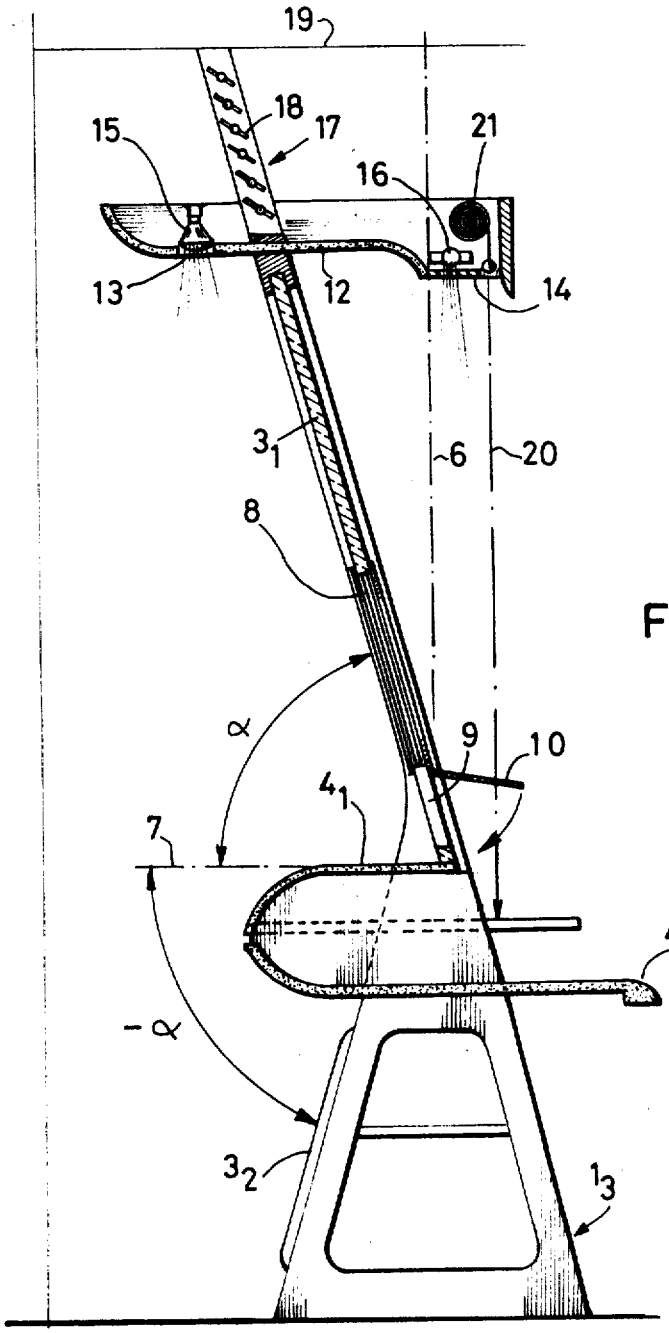

A constructional element according to the invention is shown merely by way of example in the accompanying drawings in which:

FIG. 1 is a perspective view of a constructional element according to the invention, and FIG. 2 is a cross-sectional view of said element.

In the embodiment shown in FIGS. 1 and 2, the constructional element or panel comprises four members, two parallel posts $\mathbf{1}_1$–$\mathbf{1}_2$, a separating wall 3 engaged between said two post and a counter 4.

The posts $\mathbf{1}_1$–$\mathbf{1}_2$ are made from metal L-section members and strips forming a U-section and constituting in their lower half stands $\mathbf{1}_3$ of substantially triangular shape so that there is formed an excellent supporting polygonal structure. The rectilinear part $\mathbf{1}_1$–$\mathbf{1}_2$ of these posts is inclined relative to the bisector b of the apex angle of the stand $\mathbf{1}_3$, this inclination being directed toward the public side, the public being diagrammatically represented by the client c who is facing the counter. This inclination is so arranged as to avoid placing the centre of gravity of the posts in an eccentric position so as to avoid adversely affecting the stability of their seating on the ground. The posts $\mathbf{1}_1$–$\mathbf{1}_2$ are provided with one or more fixing orifices 5 for the passage of assembling means which permit the juxtaposition of one or more identical constructional elements to form continuous walls which may be connected to fixed partitions contained in the same plane as the constructional elements according to the invention or to walls contained in an orthogonal plane.

The separating wall 3 engaged between the two posts $\mathbf{1}_1$–$\mathbf{1}_2$ comprises a transparent upper part $\mathbf{3}_1$ which extends down to the upper level $\mathbf{4}_1$ of the counter. This wall is preferably made from bullet-proof high-security glass. The essential feature of this wall $\mathbf{3}_1$ resides in the fact that it makes, owing to the inclination of the posts $\mathbf{1}_1$–$\mathbf{1}_2$ (with respect to the vertical plane 6 in FIG. 2 an angle $\alpha$ less than a right angle defined by the transverse horizontal plane 7 of the counter and the vertical 6). The acute angle $\alpha$ made by the counter with the transparent wall $\mathbf{3}_1$ of the constructional element is extremely important, since the inclination of this wall toward the hall reserved for the public constitutes an obstacle impossible to pass through for the criminals who wish to pass to the other side, which inclination in addition to the resistant character of the material of the wall $\mathbf{3}_1$ renders the constructional element a unit which precludes any passage therethrough or thereover.

The wall $\mathbf{3}_2$ below the counter is preferably opaque and may be made from any strong material such as wood, metal, plastics material or any other fibre-board or agglomerated material which may or may not include a reinforced bullet-proof core. This wall $\mathbf{3}_2$ also makes an angle $\alpha$ less than a right angle with respect to the vertical reference plane 6 and to the transverse horizontal plane 7 of the counter in the considered embodiment.

The counter 4 is constructed in the form of a single-piece shell of moulded plastics material, wood or metal which interconnects the two posts $\mathbf{1}_1$–$\mathbf{1}_2$ of the constructional element. Preferably, these posts have on their inner sides horizontal section members, for example U-section members, so as to form slideways (not shown) supporting the counter. The shell 4 constituting the counter is formed by two branches of unequal lengths, the shorter branch $\mathbf{4}_1$ constituting a desk for the public while the longer branch $\mathbf{4}_2$ constitutes a shelf for the officer.

The upper wall $\mathbf{3}_1$ may be provided with a window for oral communication between the officer and the public and the transfer of documents, objects or money, such as a window according to any of the French patents of which the firm Société HYGIAPHONE is proprietor.

In any case, the window is formed by a part 8 for the passage of sounds and an opening 9 allowing the passage of objects or documents, this opening being capable of being closed by a flap 10 which may be locked from the officer's side. If a window is used which does not have an opening 9 but only an oral communication part, it is possible to provide an opening $\mathbf{4}_3$ in the counter 4 which may be closed by a flap 11. This opening may moreover receive a movable bowl or the like for the passage of objects or documents which precludes direct passage to the other side of the window. In this way, criminals are unable to pass a fire arm through the opening $4_3$ and menace the officer shown at a.

The constructional element further comprises a box structure 12 provided with two openings 13 and 14 on each side of the wall $3_1$ for the passage of light produced by illuminating means 15 and 16 housed within the box structure 12. The wall $3_1$ is continued above the box structure 12 in the form of a ventilating region 17 formed by orientable slats. In the presently-described embodiment, the wall $3_1$ consequently extends up to the ceiling 19.

In order to ensure that the officers are not menaced in the event of in particular an armed attack, the constructional element is provided with a closing curtain 20 in the form of an opaque sheet which is normally wound on a reel 21 housed within the box structure 12 and is capable of being automatically and immediately unwound in the event of a menace so as to mask the transparent wall $3_1$ and consequently hide the officers from the view of the attackers.

The constructional element or panel according to the invention is simple and relatively cheap to make, notwithstanding the fact that it affords high security and its shapes have been designed to be aesthetic and to perfectly harmonize with the other decorative elements employed in the premises reserved for the public.

It must be understood that the scope of the invention is not intended to be limited to the embodiment described hereinbefore in respect of which other forms or other constructional means may be envisaged without departing from the scope of the invention defined in the claims.

We claim:

1. In a constructional element in particular for the equipment of premises used by the public for defining between the public and an officer isolated in another premises a transparent separating structure which however permits oral communication and exchanges of objects or documents, the element comprising a counter having a substantially horizontal upper part, an upper separating wall surmounting the counter, a major part of which wall is made from a transparent material and is inclined with respect to the vertical upwardly and toward the public premises side, the element having a part located below the upper substantially horizontal part of the counter, a lower wall closing said lower part, the improvement wherein, apart from the upper part of the counter, the upper wall and the lower wall, the constructional element comprises only two spaced-apart lateral posts which are contained in vertical planes and have elongated and inclined upper parts, between which upper parts said upper wall is maintained, and wider lower parts which provide the element with a suitable supporting polygonal structure, the upper part of the counter and the lower wall being maintained between said lower parts.

2. An element according to claim 1, wherein the wider lower parts of the posts comprise two stands of triangular-shape which bear on the ground, the stands having one side which is extended by U-section members which constitute said upper parts of the posts and receive the upper separating wall.

3. An element according to claim 2, wherein the lower separating wall which extends from the upper part of the counter to the ground is also inclined downwardly and toward the public premises side with respect to the vertical.

4. An element according to claim 2, wherein the triangular-shaped stands have an apex which is located above the upper part of the counter.

5. An element according to claim 3, wherein the upper part of the counter is formed by a single-piece shell having two branches of unequal lengths, the shorter branch receiving the lower edge of the upper separating wall and constituting a desk on the public premises side, and the longer branch being below the first branch and constituting a shelf on the officer's side.

6. An element according to claim 5, wherein the upper part of the counter is located above the lower separating wall and is maintained horizontal by slideways inside the posts.

7. An element according to claim 1, wherein the lower wall is opaque and made from a rigid material and the upper wall is made from a bullet-proof material.

8. An element according to claim 1, wherein the upper wall is provided with a communicating window having a sound-transmitting vibrating diaphragm and an opening for the passage of objects or documents, a flap which may be locked from the officer's side being combined with said opening.

9. An element according to claim 8, wherein the flap for the passage of objects or documents is disposed in the counter which has a transfer opening for this purpose.

10. An element according to claim 1, comprising a masking curtain wound on winding means located in an upper part of the transparent wall, this curtain being controlled by control means which produce an instantaneous unwinding of the curtain.

11. An element according to claim 1, comprising an illuminating box structure extending on opposite sides of an upper part of the transparent wall and defining two openings located vertically above the public and the officer for illuminating opposite sides of the counter.

* * * * *